US007641189B2

(12) United States Patent
Nobe et al.

(10) Patent No.: US 7,641,189 B2
(45) Date of Patent: Jan. 5, 2010

(54) SHEET FEEDER AND IMAGE FORMING APPARATUS WITH COOPERATING SUPPLY TRAY PRESSING PLATE AND SHEET SEPARATION ELEMENT

(75) Inventors: Hiroshi Nobe, Nagoya (JP); Hikaru Iino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/372,786

(22) Filed: Feb. 18, 2009

(65) Prior Publication Data

US 2009/0206543 A1 Aug. 20, 2009

(30) Foreign Application Priority Data

Feb. 18, 2008 (JP) ..... 2008-036091

(51) Int. Cl.
*B65H 1/08* (2006.01)

(52) U.S. Cl. ..... 271/127; 271/121

(58) Field of Classification Search ..... 271/121, 271/127, 167

See application file for complete search history.

(56) References Cited

U.S. PATENT DOCUMENTS

| | | | | |
|---|---|---|---|---|
| 6,257,569 | B1 * | 7/2001 | Rhodes et al. | 271/117 |
| 6,260,839 | B1 * | 7/2001 | Araki et al. | 271/10.11 |
| 7,252,446 | B2 | 8/2007 | Katayama et al. | |
| 7,312,808 | B2 | 12/2007 | Kato et al. | |
| 7,319,476 | B2 | 1/2008 | Kato et al. | |
| 7,396,174 | B2 | 7/2008 | Hattori | |
| 7,461,840 | B2 | 12/2008 | Hattori | |
| 2005/0220479 | A1 | 10/2005 | Ito et al. | |
| 2005/0220482 | A1 | 10/2005 | Ishii | |
| 2005/0220517 | A1 | 10/2005 | Matsushima et al. | |
| 2006/0180986 | A1 | 8/2006 | Hattori | |
| 2006/0180987 | A1 | 8/2006 | Hattori | |

FOREIGN PATENT DOCUMENTS

| | | | |
|---|---|---|---|
| JP | 2-023129 | A | 1/1990 |
| JP | 5-201557 | A | 8/1993 |
| JP | 6-061848 | U | 9/1994 |
| JP | 9-150979 | A | 6/1997 |
| JP | 2001-019194 | A | 1/2001 |
| JP | 2001-158550 | A | 6/2001 |
| JP | 2005-225602 | A | 8/2005 |
| JP | 2006-052041 | A | 2/2006 |
| JP | 2006-096479 | A | 4/2006 |
| JP | 2006-176321 | A | 7/2006 |

* cited by examiner

*Primary Examiner*—Patrick H Mackey
*Assistant Examiner*—Gerald W McClain
(74) *Attorney, Agent, or Firm*—Banner & Witcoff, Ltd.

(57) ABSTRACT

A sheet feeder feeds a sheet to an image forming unit. The sheet feeder can include a supply tray that holds a stack of sheets, a separation element disposed at an end of the supply tray, and configured to contact and apply a resistive force to a sheet in the stack, and a separation roller disposed facing the separation element, and configured to rotate, contact and apply a feeding force to an uppermost sheet in the stack. The sheet feeder may also include a pressing plate pivotally attached to the supply tray at an end remote from the separation element, and configured to move toward the separation element as a number of sheets in the stack decreases, and a pressure applying element that increases a contact surface pressure between the separation element and the uppermost sheet in response to the pressing plate moving toward the separation element.

12 Claims, 8 Drawing Sheets

SHEET FEEDER AND IMAGE FORMING APPARATUS WITH COOPERATING SUPPLY TRAY PRESSING PLATE AND SHEET SEPARATION ELEMENT

CROSS REFERENCE TO RELATED APPLICATION

This application claims priority from Japanese Patent Application No. 2008-036091, filed on Feb. 18, 2008, the entire subject matter of which is incorporated herein by reference.

FIELD

Aspects of the invention relate to a sheet feeder configured to feed a recording medium, such as a sheet of paper, and an image forming apparatus having such a sheet feeder.

BACKGROUND

A known sheet feeder includes a sheet supply tray, a separation roller, a separation pad, and a sheet pressing plate. The sheet supply tray is configured to store a stack of recording sheets. The separation roller is disposed to rotate in contact with an uppermost sheet in the sheet supply tray and configured to apply a feeding force to the sheet. The separation pad is disposed facing the separation roller and configured to contact a sheet from an opposite side from the separation roller and provide a resistance with the sheet. The sheet pressing plate is disposed inside the sheet supply tray. The sheet pressing plate is pivotally supported at one end remote from the separation pad such that the sheet pressing plate is vertically movable at the other end closest to the separation pad as the number of recording sheets stored in the sheet supply tray decreases.

However, when the sheet pressing plate ascends, a friction surface of the separation pad that contacts the recording sheet and an imaginary plane including the sheet pressing plate forms a small angle, and the friction surface and the imaginary plane become close to parallel to each other.

At this time, a recording sheet is fed from the sheet supply tray to the separation pad in a direction parallel to the sheet pressing plate and contacts the friction surface of the separation pad. When the sheet pressing plate ascends and the friction surface and the imaginary plane become close to parallel, a frictional force generated between the friction surface of the separation pad and the recording sheet becomes small.

Thus, when the sheet pressing plate ascends, the frictional force between the friction surface of the separation pad and the recording sheet becomes small and a sufficient resistance may not be applied to the recording sheet. As a result, multi-feeding where multiple recording sheets are erroneously fed at a specific time may occur.

SUMMARY

Illustrative aspects of the invention can provide a sheet feeder configured to prevent multi-feeding and an image forming apparatus having the sheet feeder.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. A sheet feeder according to illustrative aspects of the invention applies to a feeder mechanism in an image forming apparatus 1 as shown in FIG. 1.

For ease of discussion, in the following description, the top or upper side, the bottom or lower side, the left or left side, the right or right side, the front or front side, and the rear or rear side are used to define the various parts when the image forming apparatus 1 is disposed in an orientation in which it is intended to be used. In FIG. 1, the left side is referred to as the rear or the rear side, the right side is referred to as the front or front side, the up side is referred to as the top or upper side, and the down side is referred to as the bottom or lower side.

Figure 1:
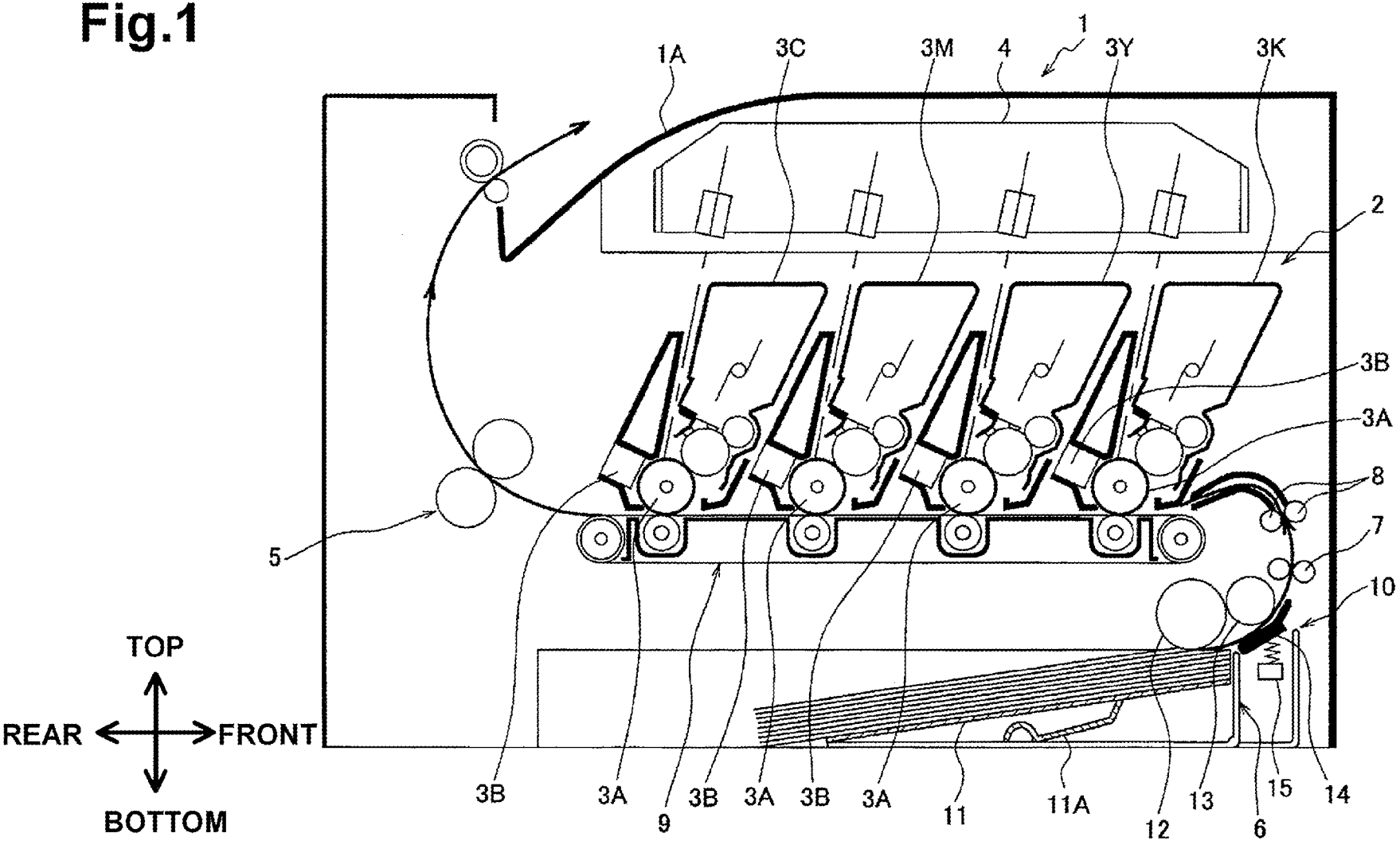
FIG. 1 is a side sectional view of an internal structure of an image forming apparatus as an illustrative example of an image forming apparatus using features described herein.

As shown in FIG. 1, the image forming apparatus 1 may include an image forming section 2 and a sheet supply mechanism (a sheet feeder) 10. The image forming section 2 may be configured to form an image on a recording medium such as a recording sheet (e.g., plain paper, transparency, etc.), and include four process cartridges 3K, 3Y, 3M, 3C, a light exposing unit 4, and a fixing unit 5.

The image forming section 2 employs a direct tandem system in which four color developer images formed by the process cartridges 3K, 3Y, 3M, 3C storing developers (toners) of black (K), yellow (Y), magenta (M), and cyan (C) respectively, are overlapped with one another on a recording sheet to form a color image.

An uppermost recording sheet is separated and picked up from the stack of recording sheets in the sheet supply tray 6 by the sheet supply mechanism 10, dust is removed from the recording sheet by a dust removing roller 7, and the recording sheet is fed between a pair of registration rollers 8 to correct skew of the recording sheet, and then to a belt unit 9.

The process cartridges 3K, 3Y, 3M, 3C are arranged in tandem in this order from the front of the image forming apparatus 1 so as to face a conveyance surface of the belt unit 9 on which the recording sheet is conveyed or fed. In other words, the process cartridges 3K, 3Y, 3M, 3C are arranged above the conveyance surface of the belt unit 9 in this order from an upstream side along a direction where the recording sheet is fed (hereinafter referred to as a sheet feeding direction). In this illustrative embodiment, developer images of black, yellow, magenta, and cyan are sequentially transferred onto the recording sheet being fed on the belt unit 9, and fixed by the fixing unit 5 to the recording sheet.

Each process cartridge 3K, 3Y, 3M, 3C includes a photosensitive drum 3A and a charger 3B. The photosensitive drum 3A is configured to carry a developer image thereon, and the charger 3B is configured to charge the photosensitive drum 3A. The charged photosensitive drum 3A is exposed to light by the light exposing unit 4, and an electrostatic latent image is formed on a surface of the photosensitive drum 3A. A developer is supplied to the photosensitive drum 3A, and a developer image is carried on the surface of the photosensitive drum 3A.

The recording sheet on which an image has been formed is ejected from the fixing unit 5, the sheet is fed in an upward direction, and the recording sheet is ejected onto an output tray 1A disposed on a top surface of the image forming apparatus 1.

The sheet supply mechanism 10 may be configured to separate a single recording sheet from the top of a stack of recording sheets stored in the sheet supply tray 6 and feed the recording sheet to the image forming section 2. As shown in FIG. 1, the sheet supply mechanism 10 may include the sheet supply tray 6, a pressing plate 11, a pickup roller 12, a separation roller 13, and a pad lift arm 15.

In this illustrative embodiment, operations and workings of the pressing plate 11, the pickup roller 12, and the separation roller 13 are the same as those disclosed in U.S. Patent No. 2006/180986 A1, which is herein incorporated by reference. The following generally describes the structures and operations of the pressing plate 11, the pickup roller 12, and the separation roller 13.

A recording sheet stored in the sheet supply tray 6 is given a feeding force by the pickup roller 12 and the separation roller 13, and is fed toward the dust removing roller 7. In other words, the pickup roller 12 rotates in contact with the uppermost recording sheet of a stack stored in the sheet supply tray 6 and applies a feeding force to the recording sheet.

At this time, the pickup roller 12 rotates while pressing the stack of recording sheets toward the pressing plate 11, and thus, at least one upper recording sheet including the uppermost recording sheet is fed together toward the separation roller 13.

The separation roller 13 contacts only the uppermost recording sheet and applies a feeding force to feed the uppermost recording sheet toward the dust removing roller 7.

A separation element such as a separation pad 14 is disposed facing the separation roller 13 and is configured to contact a recording sheet on a side opposite the side which contacts the separation roller 13 and provide a resistive force to the recording sheet. Some recording sheets fed by the pickup roller 12, such as recording sheets in contact with or closer to the separation pad 14 than the uppermost recording sheet in contact with the separation roller 13, are prevented from being fed to the dust removing roller 7.

Figure 4:
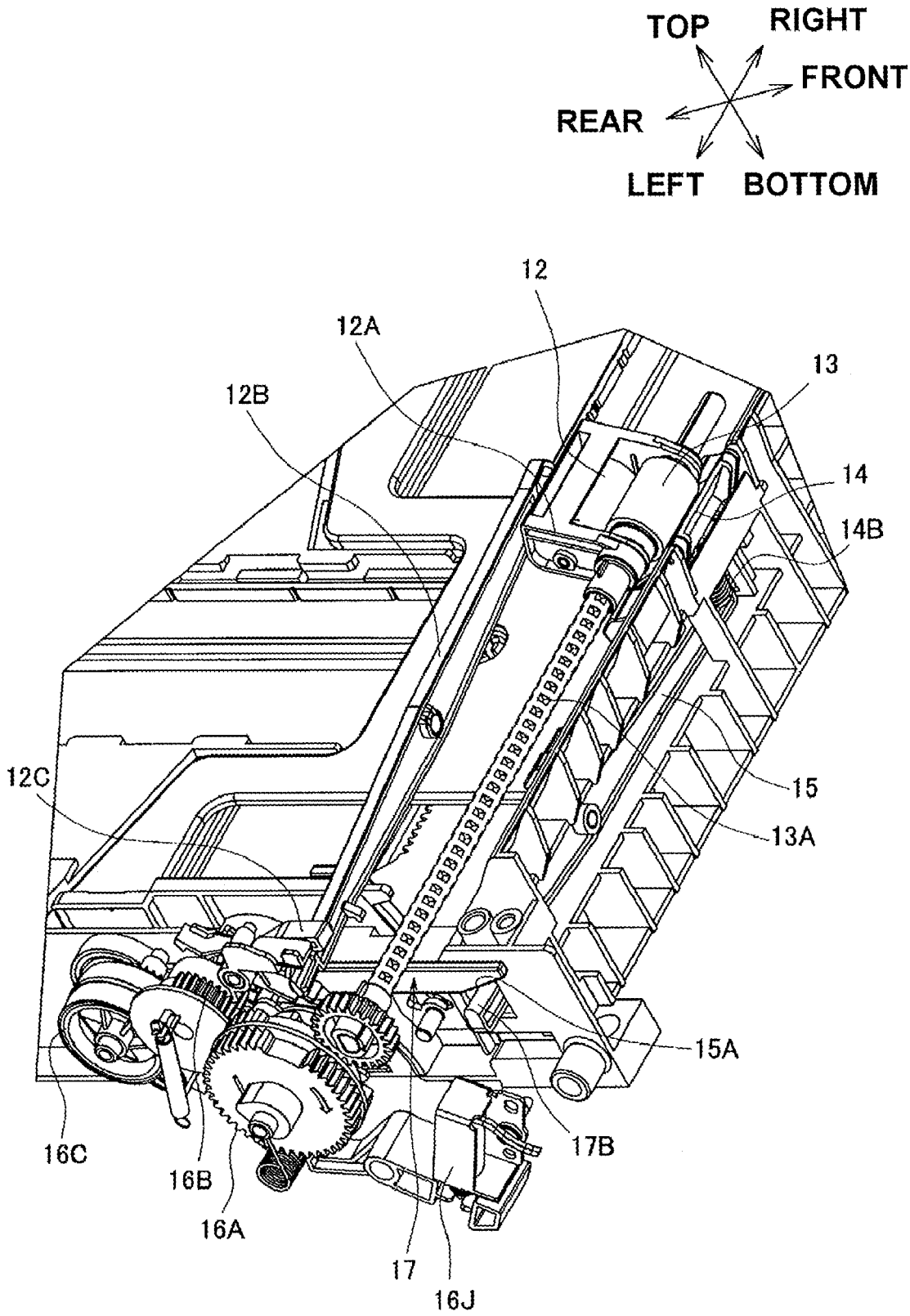
FIG. 4 is an enlarged perspective view of an oscillating mechanism configured to move a sheet pressing plate according to illustrative aspects.
Figure 5:
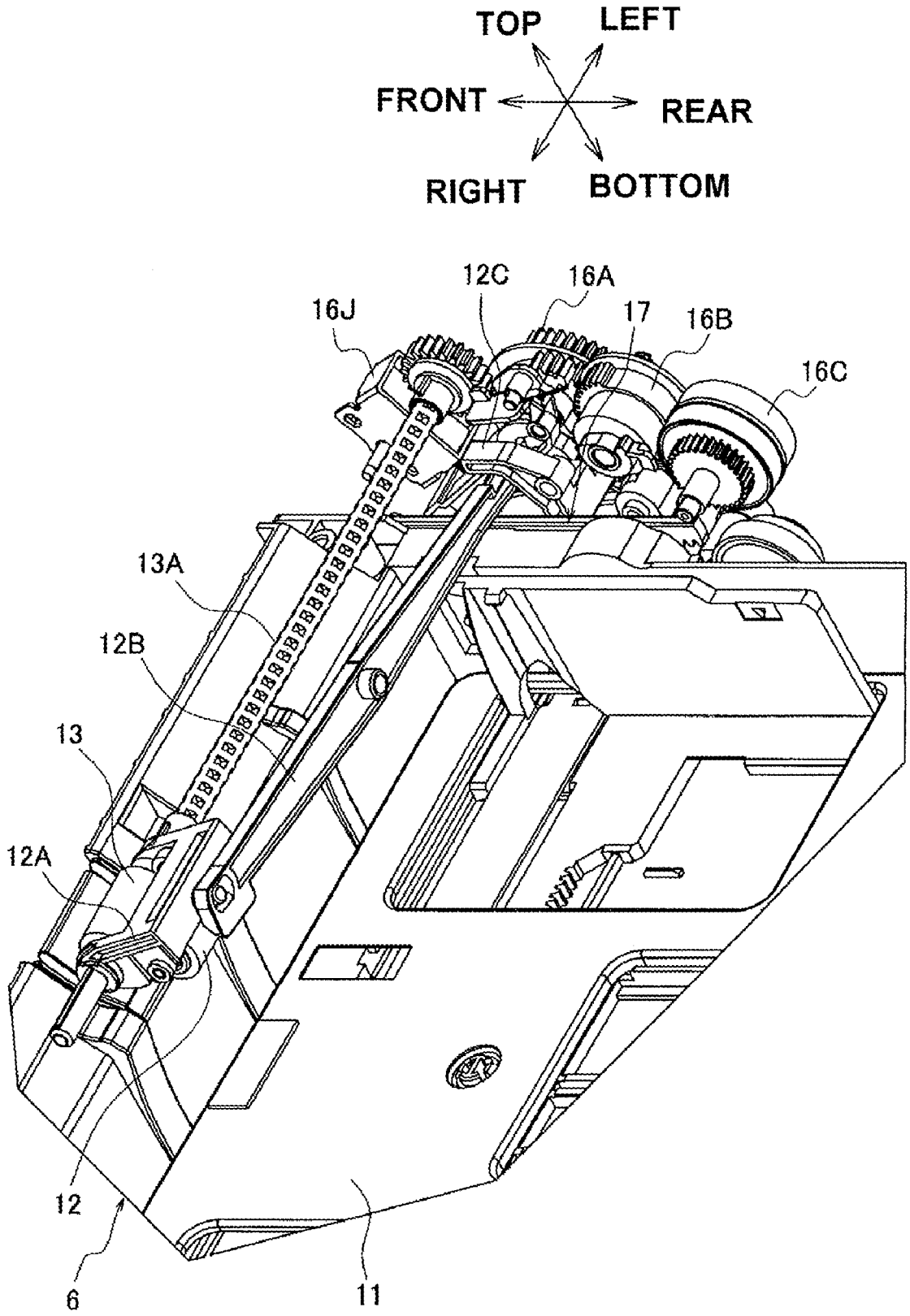
FIG. 5 is an enlarged perspective view of the oscillating mechanism configured to move the sheet pressing plate.
Figure 6:
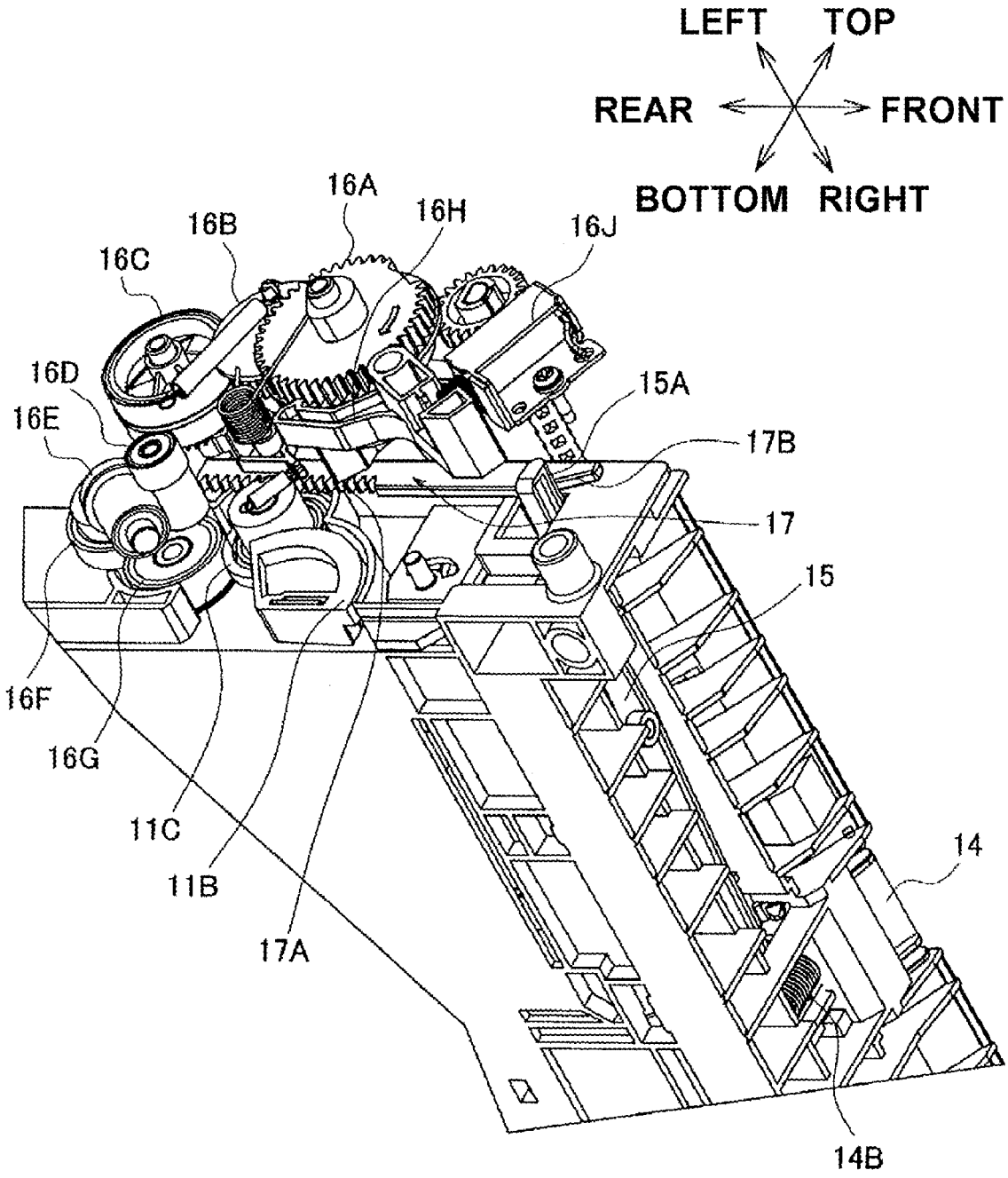
FIG. 6 is an enlarged perspective view of the oscillating mechanism configured to move the sheet pressing plate.
Figure 7:
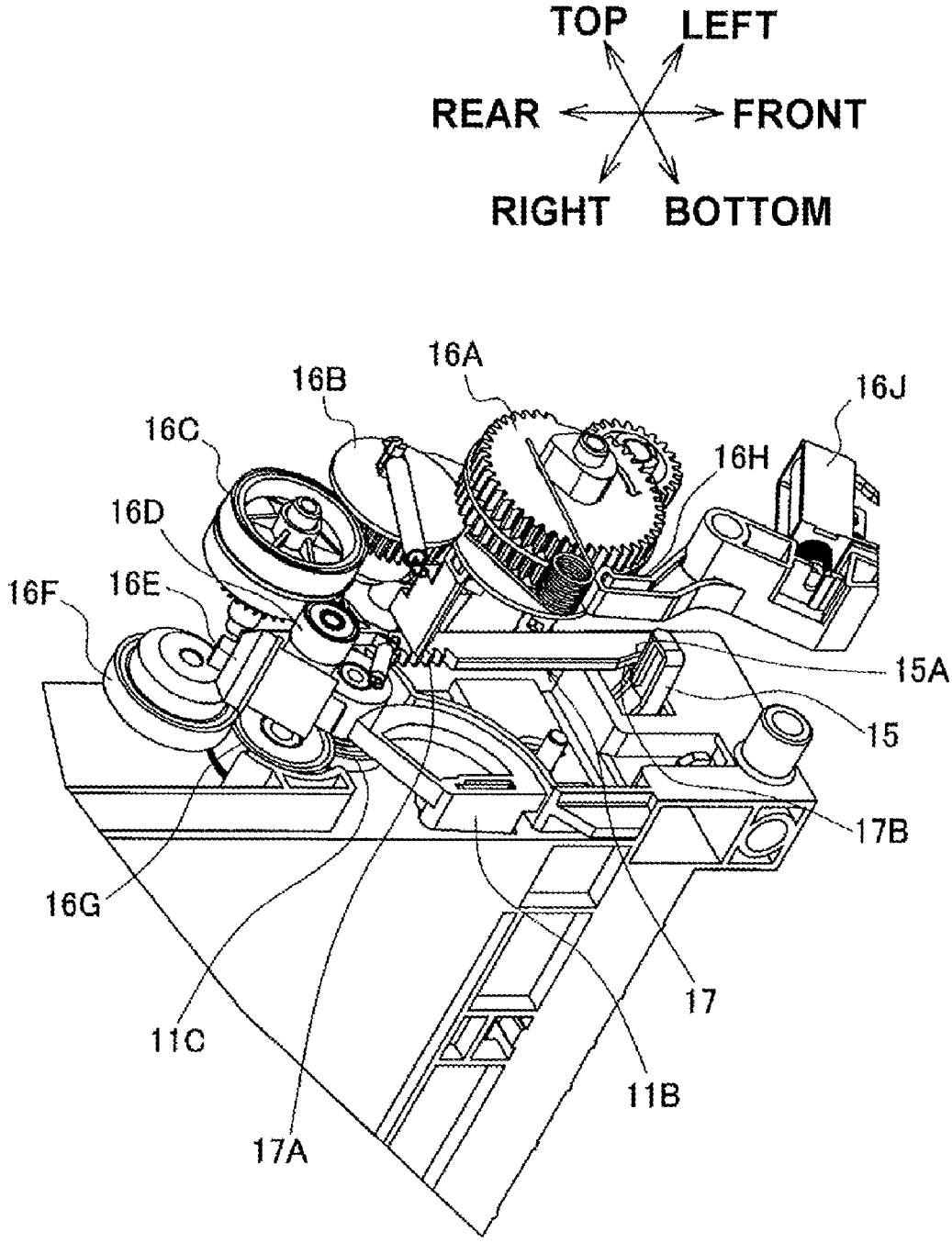
FIG. 7 is an enlarged perspective view of the oscillating mechanism configured to move the sheet pressing plate.

As shown in FIGS. 4 and 5, the pickup roller 12 is rotatably mounted in an oscillating arm 12A that is movably attached to a rotating shaft 13A of the separation roller 13. The pickup roller 12 receives a force to rotate from the rotating shaft 13A via an intermediate gear (not shown) rotatably supported by the oscillating arm 12A. The rotating shaft 13A supports the separation roller 13 and causes the separation roller 13 to rotate.

In the illustrative embodiment, when a recording sheet is not fed, the pickup roller 12 enters a stand-by state or stays at its home position shown in FIGS. 4 and 5 where it is sufficiently away from a recording sheet. When a recording sheet is fed, the pickup roller 12 moves from its home position downward to the pressing plate 11, and rotates in contact with a recording sheet.

A roller lift arm 12B is configured to keep the pickup roller 12 in a stand-by state. The roller lift arm 12B is pivotally attached to the oscillating arm 12A at a right end and is engaged with a lift lever 12C at a left end, such that the roller arm 12B reciprocally moves at a central portion with respect to its longitudinal direction.

When the left end of the roller lift arm 12B is engaged with the lift lever 12C (in a state shown in FIGS. 4 and 5), the pickup roller 12 is in the stand-by sate. When the other end of the roller lift arm 12B is released from the lift lever 12C, the oscillating arm 12A oscillates downward toward the pressing plate 11 by the weight of the pickup roller 12, so that the pickup roller 12 contacts a recording sheet. This state is referred to as the operation state.

As shown in FIG. 1, the pressing plate 11 is pivotally mounted to the sheet supply tray 6 at the front side, such that the pressing plate 11 is capable of ascending at the rear side close to the separation pad 14 as the number of recording sheets stored in the sheet supply tray 6 decreases.

Figures 8A, 8B, 8C, 8D, 8E, 8F:
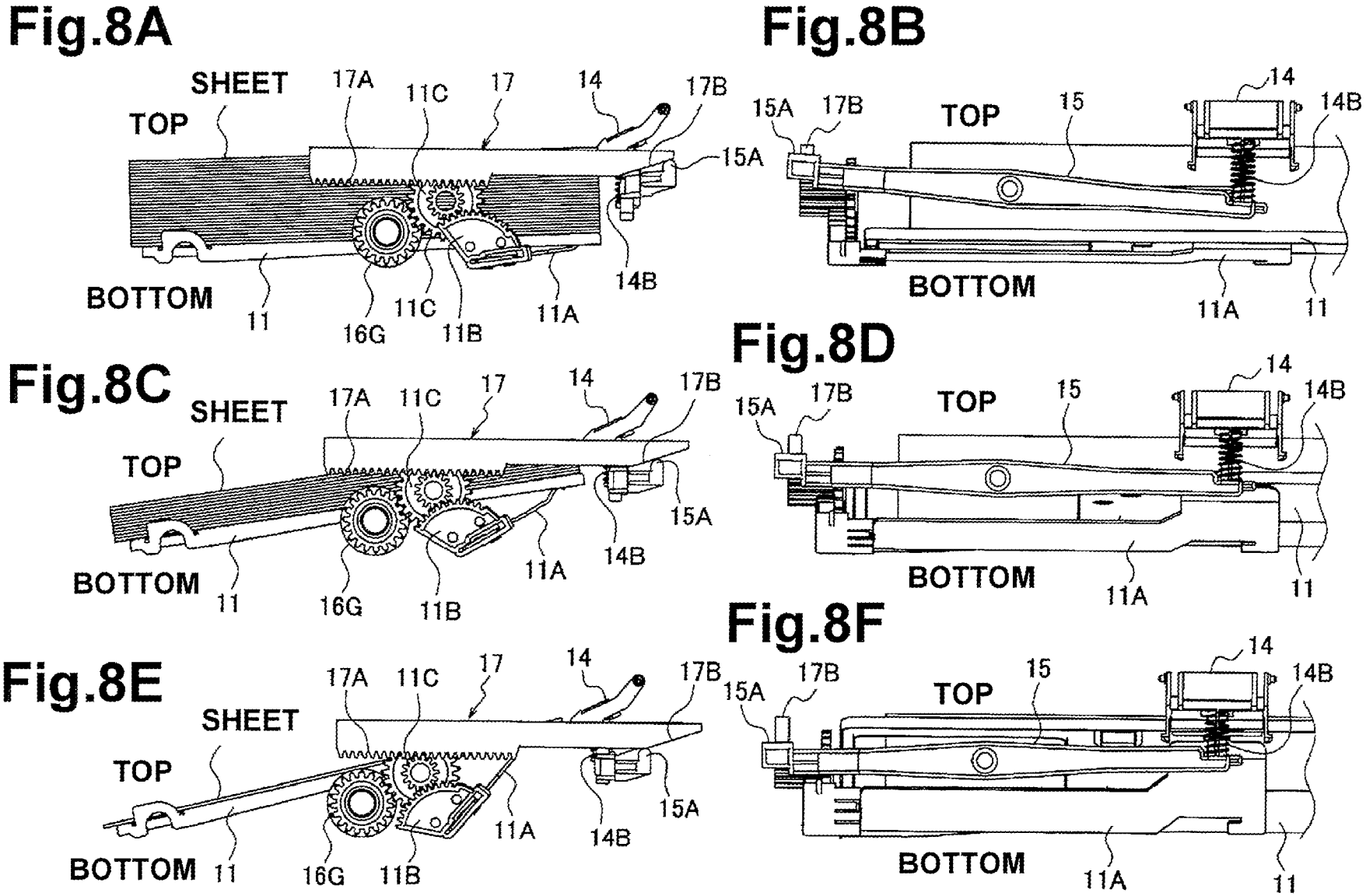
FIGS. 8A, 8C and 8E show a series of operations of ascending sheet pressing plate according to illustrative aspects.
FIG. 8B is a right side view of FIG. 8A.
FIG. 8D is a right side view of FIG. 8C.
FIG. 8F is a right side view of FIG. 8E.

A lifting lever 11A is configured to raise the pressing plate 11. The lifting lever 11A is attached to a side surface of a sector gear 11B as shown in FIGS. 8A, 8C and 8E and rotates along with the sector gear 11B. The sector gear 11B receives a drive force from a drive gear 11C and rotates.

A force to rotate the drive gear 11C is transmitted from a drive motor (not shown) disposed in a main body of the image forming apparatus 1 to the drive gear 11C while its speed is slowed down via gears 16A to 16G.

The gear 16A is provided with a clutch mechanism that is configured to switch between a mode to transmit power to the drive gear 11C and a mode to interrupt power transmission. The clutch mechanism interrupts power transmission when the roller lift arm 12B is in the operation state and the other end of the roller lift arm 12B (which is engaged to the lift lever 12C) is below a predetermined height. The predetermined height is a height where the pickup roller 12 contacts the uppermost sheet in the sheet supply tray 6 in the vicinity of the separation pad 14.

The clutch mechanism transmits power to the drive gear 11C when the roller lift arm 12B is in the operation state and the other end of the roller lift arm 12B is raised above the predetermined height, that is, when the pickup roller 12 approaches the pressing plate 11 from when it is in the stand-by state.

When the number of recording sheets stored in the sheet supply tray 6 decreases and the pickup roller 12 approaches the pressing plate 11 from when it is in the stand-by state, the pressing plate 11 moves upward and a distance between the uppermost recording sheet in the sheet supply tray 6 and the separation pad 14 is maintained within a specified range.

An engagement catch 16H is configured to switch between a mode to permit rotation of the gear 16A and a mode to disable rotation of the gear 16A. When a sheet supply order is issued and a solenoid 16J is energized, the engagement catch 16H and the gear 16A are disengaged from each other, and the gear 16A is able to rotate.

Conversely, when the sheet supply order is stopped and energizing of the solenoid 16J is interrupted, the engagement catch 16H engages with the gear 16A and the gear 16A becomes incapable of rotation.

Figure 2:
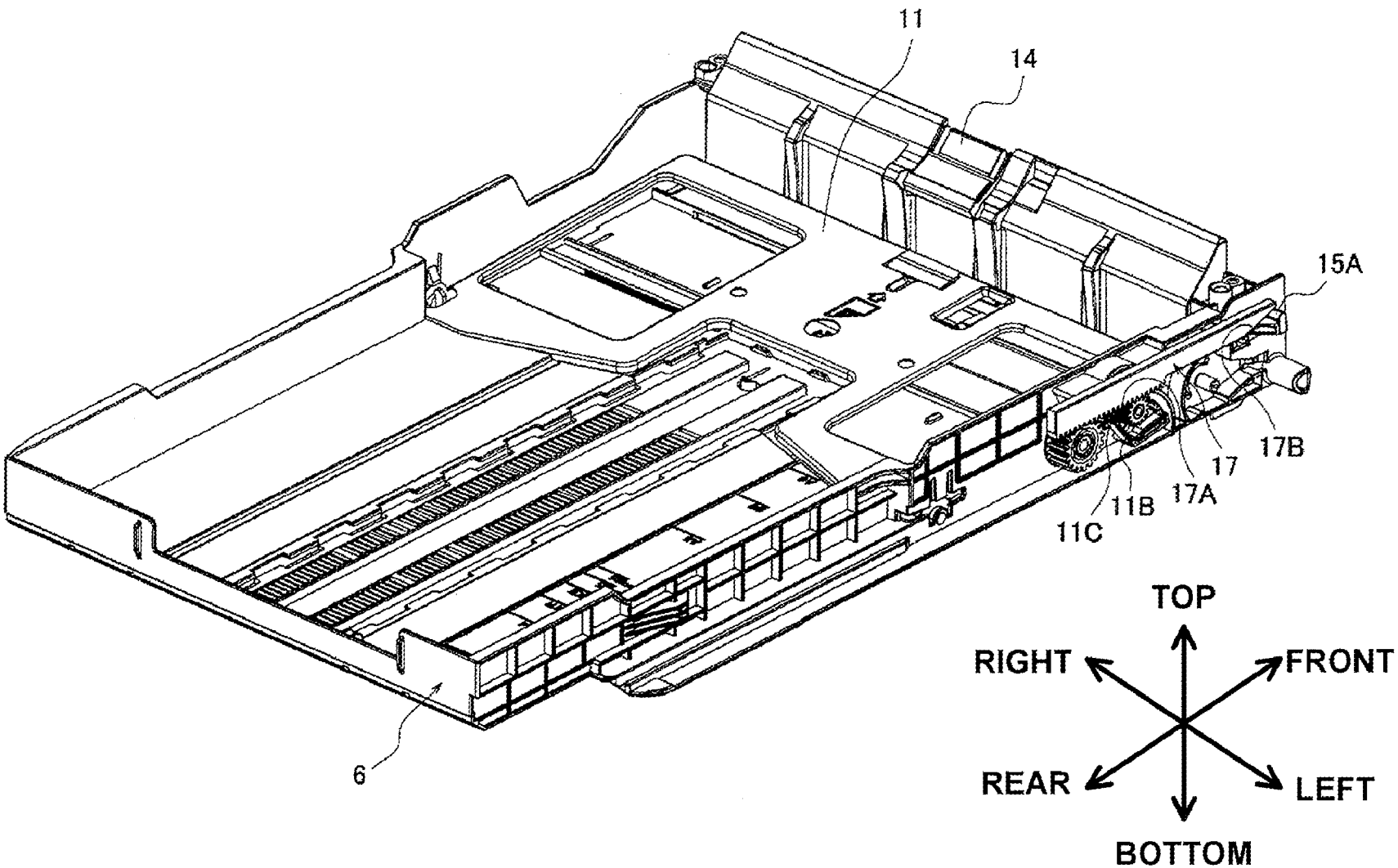
FIG. 2 is a perspective view of a sheet supply tray including a sheet supply mechanism according to illustrative aspects.

As shown in FIG. 2, the separation pad 14 is disposed at a forward end of the sheet supply tray 6 with respect to the sheet feeding direction (e.g. a front upper end of the sheet supply tray 6 in this embodiment), and in a central portion with respect to a width of the sheet supply tray 6. The separation pad 14 is pivotally assembled in the sheet supply tray 6 so as to change its position in a direction to move toward or away from the separation roller 13 (hereinafter referred to as a pad displacement direction).

Figure 3:
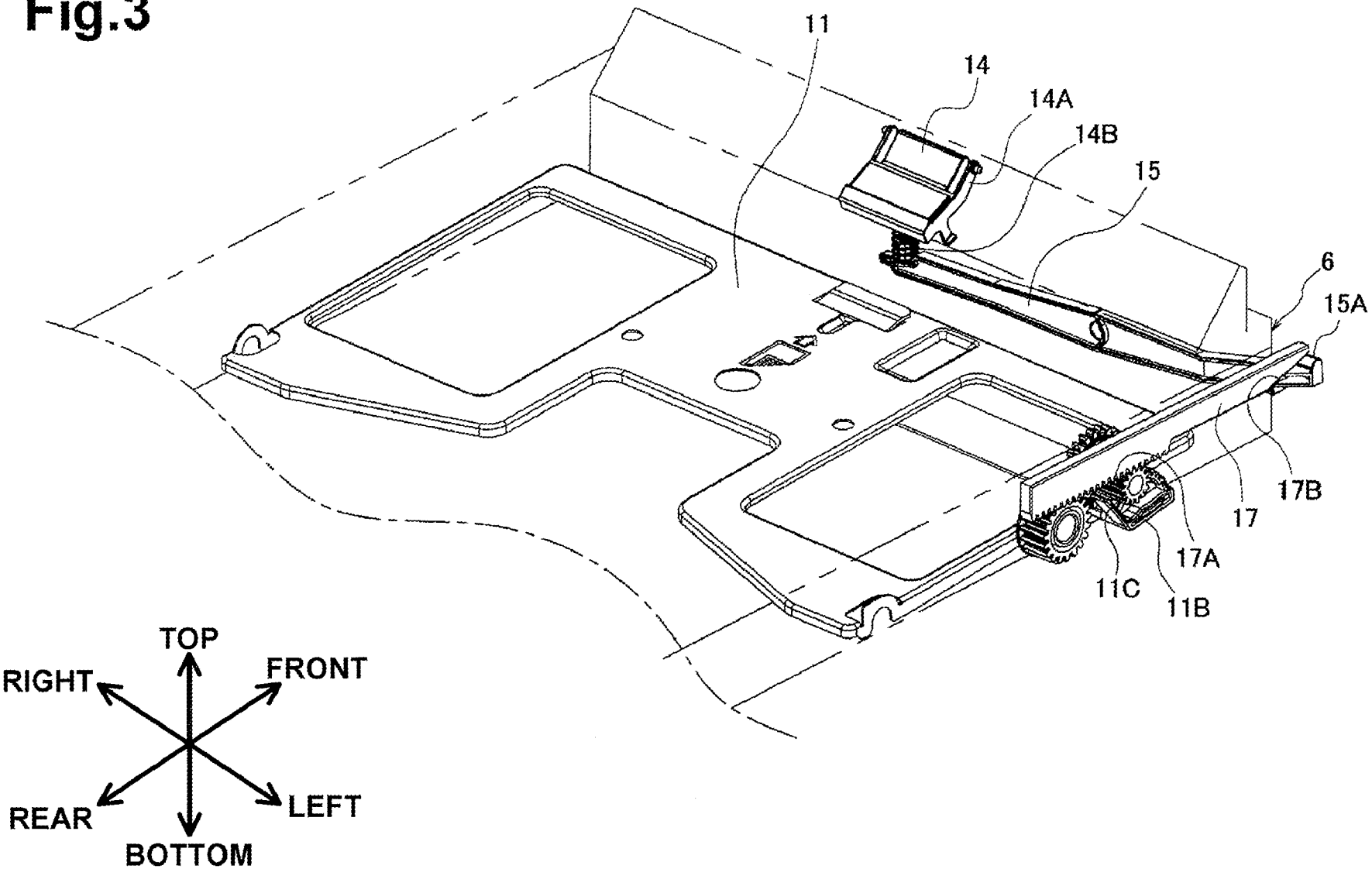
FIG. 3 is an enlarged perspective view of the sheet supply tray of FIG. 2.

As shown in FIG. 3, the separation pad 14 is held in a pad holder 14A, which is disposed at an inside front surface of the sheet supply tray 6. Specifically, a front end of the pad holder 14A is pivotally assembled to the inside front surface of the sheet supply tray 6, and a rear end of the pad holder 14A is supported by an elastic member, e.g. a coiled spring 14B from underneath.

The coiled spring 14B is configured to press the separation pad 14 toward the separation roller 13. The spring 14B is disposed such that an upper end of the spring 14B is connected to the pad holder 14A and a lower end of the spring 14B is connected to a right end of a pad lift arm 15 with respect to its longitudinal direction. The pad lift arm 15 is an arm link member extending from a left end of a front side of the sheet supply tray 6 to a central portion of the front side where the separation pad 14 is disposed. The pad lift arm 15 is pivotally supported at its central portion, with respect to its longitudinal direction, to the sheet supply tray 6.

Thus, when a left end of the pad lift arm 15 is pressed downward, the spring 14B is pressed by the pad lift arm 15 and the separation pad 14 is moved toward the separation roller 13.

The separation roller 13 is supported by the rotation shaft 13A and does not move in the pad displacement direction. When the separation pad 14 is moved toward the separation roller 13, a pressure generated at a contact surface between the separation pad 14 and the recording sheet (hereinafter referred to as a contact surface pressure) increases.

When the left end of the pad lift arm 15 is moved upward, the right end of the pad lift arm 15 is moved downward, the spring 14B extends, and the separation pad 14 is moved away from the separation roller 13. Thus, the contact surface pressure decreases.

A rack cam 17 is configured to convert rotational movement of the drive gear 11C into parallel movement (e.g. in the front-rear direction) and transmit the parallel movement to the pad lift arm 15. The rack cam 17 includes a rack gear portion 17A and a cam portion 17B. The rack gear portion 17A is engaged with the drive gear 11C. The cam portion 17B slidably contacts a curved cam surface 15A formed at the left end of the pad lift arm 15 and moves the left end of the pad lift arm 15 in a direction parallel to the pad displacement direction (e.g., a vertical direction in this illustrative embodiment).

The pad lift arm 15 and the rack cam 17 can be constructed of high rigid resin because they are subjected to a bending moment and undulation. The cam portion 17B, the cam surface 15A, and the rack gear portion 17A generally are configured to have high wear resistance.

As described above, the sector gear 11B that moves the lifting lever 11A of the pressing plate 11 is driven by the drive gear 11C and rotates, the rack gear portion 17A of the rack cam 17 is engaged with the drive gear 11C, and the pad lift arm 15 moves the separation pad 14 mechanically in response to the movement of the pressing plate 11.

When the number of recording sheets in the sheet supply tray 6 is large as shown in FIGS. 8A and 8B, the pressing plate 11 is placed generally horizontally such that its front end is separated away from the separation pad 14. With this state, the separation pad 14 contacts the separation roller 13 with a relatively small contact surface pressure.

When the number of recording sheets in the sheet supply tray 6 decreases, the front end of the pressing plate 11 moves upward close to the separation pad 14 in the order of states shown in FIGS. 8C and 8E. In addition, the separation pad 14 also moves upward toward the separation roller 13 in the order of states shown in FIGS. 8D and 8F.

In the illustrative embodiment, the contact pressure between the separation pad 14 and the recording sheet increases in connection with the upward movement of the pressing plate 11. Thus, a sufficient resistance can be provided to the recording sheet, which can prevent multi feeding of recording sheets.

The recording sheet contacts both the separation pad 14 and the separation roller 13. Thus, if at least one of the separation pad 14 and the separation roller 13 is moved toward the recording sheet in accordance with the displacement of the pressing plate 11, the contact pressure between the separation pad 14 and the recording sheet can be increased in accordance with the upward displacement of the pressing plate 11.

The separation roller 13 is a drive roller that applies a feeding force to the recording sheet.

The illustrative embodiment shows a structure that the separation pad 14 is displaced toward the separation roller 13 to increase the contact pressure between the separation pad 14 and the recording sheet. In comparison with a case that the separation roller 13 is displaced toward the recording sheet in accordance with the displacement of the pressing plate 11, the illustrative embodiment can prevent the sheet supply mechanism 10 from increasing in size or manufacturing costs from increasing.

In the illustrative embodiment, the pad lift arm 15 presses the separation pad 14 via the spring 14B. The spring 14B can accommodate variations in the thickness of a stack of recording sheets, variations in the dimensions of components comprising the sheet supply mechanism 10, and variations in assembly of the sheet supply mechanism 10. Thus, multi feeding can be prevented reliably.

The separation pad 14 is displaced mechanically in connection with the displacement of the pressing plate 11. Thus, the pressing plate 11 and the separation pad 14 can be displaced by a single drive source, the sheet supply mechanism 10 can be prevented from increasing in size and manufacturing costs can be prevented from rising.

The illustrative embodiment shows the sheet supply mechanism 10 that can displace the separation pad 14 in accordance with the displacement of the pressing plate 11. The sheet supply mechanism 10 is constructed from a combination of a sheet supply mechanism disclosed in U.S. Patent Application Publication No. 2006/180986 A1 and the rack cam 17.

The above illustrative embodiment shows that, but is not limited to, the recording sheets are stacked in a vertical direction. The recording sheets may be stacked in a horizontal direction.

The above illustrative embodiment shows, but is not limited to, a structure to change the contact pressure between the separation pad 14 and the recording sheet by changing the position of the separation pad 14. Instead, the separation roller 13 may be displaced, or both of the separation roller 13 and the separation pad 14 may be disposed. The spring 14B may be replaced with a pneumatic spring to change its pneumatic pressure in accordance with the displacement of the pressing plate 11.

The above illustrative embodiment shows, but is not limited to, the separation pad 14 being displaced mechanically in connection with the displacement of the pressing plate 11. The separation pad 14 may be displaced by electronically detecting the displacement of the pressing plate 11 and operating an electronic actuator based on a detection signal.

The above illustrative embodiment shows, but is not limited to, that the spring 14B is a coiled spring. The spring 14B may be an elastic member such as rubber or a leaf spring.

This illustrative embodiment shows, but is not limited to, the direct-tandem type image forming apparatus. It will be appreciated that this embodiment also applies to other types of image forming apparatuses, an intermediate transfer image forming apparatus, monochrome image forming apparatus, and an image forming apparatus having two or three process cartridges as well. In addition, development may be performed with not only a single component development method but also two-component development method.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A sheet feeder configured to feed a sheet, comprising:

a supply tray configured to hold a stack of sheets;

a separation element disposed at an end of the supply tray, the separation element being configured to contact a sheet in the stack of sheets and apply a resistive force to the sheet;

a separation roller disposed facing the separation element, the separation roller being configured to contact an uppermost sheet in the stack of sheets, rotate and apply a feeding force to the uppermost sheet;

a pressing plate pivotally attached to the supply tray at a first end remote from a second end where the separation element is disposed, the pressing plate being configured to move toward the separation element in response to a reduction in a number of sheets in the stack of sheets in the supply tray; and a pressure applying element configured to increase a contact surface pressure between the separation element and the uppermost sheet in cooperation with the separation element and the separation roller in response to movement of the pressing plate toward the separation element, the pressure applying element including an arm extending from an end of the supply tray in a width direction of the supply tray toward the separation element.

2. The sheet feeder according to claim 1, wherein the separation element is configured to move toward the separation roller, and the pressure applying element includes a pressing device that is configured to move the separation element toward the separation roller to increase the contact surface pressure.

3. The sheet feeder according to claim 2, wherein the pressure applying element further includes an elastic member that is configured to elastically deform, and wherein the pressing device is configured to cause the elastic member to move the separation element.

4. The sheet feeder according to claim 2, wherein the pressing device is configured to move the separation element in response to movement of the pressing plate.

5. The sheet feeder according to claim 1, wherein the separation element is disposed at a central portion in the end of the supply tray in a width direction of the supply tray.

6. The sheet feeder according to claim 1, wherein the width direction is parallel to an axial direction of the separation roller.

7. The sheet feeder according to claim 1, wherein the pressure applying element includes a mechanism that is disposed on an end of the supply tray and configured to move the pressing plate pivotally, and a transmission member that is configured to transmit a driving force generated at the mechanism to the arm.

8. The sheet feeder according to claim 7, wherein the mechanism includes a plurality of gears, the transmission member includes a rack gear portion and a cam portion, the rack gear portion is configured to move in a direction perpendicular to a width direction of the supply tray in engagement with the gears of the mechanism, and the cam portion is configured to contact and move the arm.

9. An image forming apparatus, comprising:

a sheet feeder for feeding a sheet comprising:

a supply tray configured to hold a stack of sheets;

a separation element disposed at an end of the supply tray, the separation element being configured to contact a sheet in the stack of sheets and apply a resistive force to the sheet;

a separation roller disposed facing the separation element, the separation roller being configured to contact an uppermost sheet in the stack of sheets, rotate and apply a feeding force to the uppermost sheet;

a pressing plate pivotally attached to the supply tray at a first end remote from a second end where the separation element is disposed, the pressing plate being configured to move toward the separation element in response to reduction in a number of sheets in the stacks of sheets in the supply tray; and a pressure applying element configured to increase a contact surface pressure between the separation element and the uppermost sheet in cooperation with the separation element and the separation roller in response to movement of the pressing plate toward the separation element, the pressure applying element including an arm extending from an end of the supply tray in a width direction of the supply tray toward the separation element; and an image formation unit configured to form an image on the sheet fed from the sheet feeder.

10. The image forming apparatus according to claim 9, wherein the width direction is parallel to an axial direction of the separation roller.

11. A sheet feeder configured to feed a sheet, comprising:

a supply tray configured to hold a stack of sheets;

separation means, disposed at an end of the supply tray, for contacting a sheet in the stack of sheets and applying a resistive force to the sheet;

a separation roller disposed facing the separation means, the separation roller being configured to contact an uppermost sheet in the stack of sheets, rotate and apply a feeding force to the uppermost sheet;

a pressing plate pivotally attached to the supply tray at a first end remote from a second end where the separation means is disposed, the pressing plate being configured to move toward the separation means in response to a reduction in a number of sheets in the stack of sheets in the supply tray; and pressure applying means for increasing a contact surface pressure between the separation means and the uppermost sheet in cooperation with the separation means and the separation roller in response to movement of the pressing plate toward the separation means, the pressure applying means including an arm extending from an end of the supply tray in a width direction of the supply tray toward the separation means.

12. The sheet feeder according to claim 11, wherein the width direction is parallel to an axial direction of the separation roller.

* * * * *